US009630033B2

(12) United States Patent
Jansson

(10) Patent No.: US 9,630,033 B2
(45) Date of Patent: Apr. 25, 2017

(54) TEMPORARY FALL PROTECTION

(75) Inventor: Kaj Jansson, Heby (SE)

(73) Assignee: ANCSAFE AB, Heby (SE)

( * ) Notice: Subject to any disclaimer, the term of this patent is extended or adjusted under 35 U.S.C. 154(b) by 185 days.

(21) Appl. No.: 14/342,688

(22) PCT Filed: Aug. 17, 2012

(86) PCT No.: PCT/SE2012/050886
§ 371 (c)(1),
(2), (4) Date: Mar. 4, 2014

(87) PCT Pub. No.: WO2013/036189
PCT Pub. Date: Mar. 14, 2013

(65) Prior Publication Data

US 2014/0202790 A1 Jul. 24, 2014

(30) Foreign Application Priority Data

Sep. 5, 2011 (SE) ..... 1100645

(51) Int. Cl.
*A62B 35/00* (2006.01)
*A62B 1/08* (2006.01)

(52) U.S. Cl.
CPC ..... *A62B 35/00* (2013.01); *A62B 1/08* (2013.01); *A62B 35/005* (2013.01)

(58) Field of Classification Search
CPC . A62B 35/04; A62B 35/0068; A62B 35/0037; A62B 35/0043; E04G 21/3261; E04G 21/328; E04G 21/3285; E04G 21/3295; E06C 7/14
See application file for complete search history.

(56) References Cited

U.S. PATENT DOCUMENTS 4,171,032 A * 10/1979 Woolslayer ..... E04G 21/3261 182/3
4,183,649 A * 1/1980 Hartley ..... E21B 19/02 254/266
4,253,218 A * 3/1981 Gibbs ..... A62B 1/14 182/5

(Continued)

FOREIGN PATENT DOCUMENTS

DE 29915360 U1 12/1999
DE 29922278 U1 * 2/2000

(Continued)

*Primary Examiner* — Katherine Mitchell
*Assistant Examiner* — Candace L Bradford
(74) *Attorney, Agent, or Firm* — Capitol City TechLaw

(57) ABSTRACT

A method of handling fall protection systems (2) in association with towers, pylons and masts includes climbing a tower (5), securing a guide channel (10) to a top portion (6) of the tower, extending a fall protection guide line (20) through the guide channel, connecting a first end (3) of a fall protection system (2) to a first end (21) of the guide line (20), extending the fall protection system (2) through the secured guide channel (10) by pulling a second end (22) of the guide line, securing the first end (3) of the fall protection system to a ground (G) level fixing point (8) and securing a second end (4) of the fall protection system to personal protection equipment worn by a worker. An assembly (1) for handling fall protection systems in association with towers, pylons and masts is also provided.

5 Claims, 4 Drawing Sheets

(56) References Cited

U.S. PATENT DOCUMENTS 4,417,718 A 11/1983 Niskin
4,607,724 A * 8/1986 Hillberg ..... E04G 21/3261 182/3
4,942,943 A * 7/1990 Flaherty ..... E04G 21/3261 182/231
5,036,949 A * 8/1991 Crocker ..... A62B 35/04 182/3
5,184,696 A * 2/1993 Meed ..... A63B 27/00 182/133
5,282,597 A * 2/1994 Babcock ..... E04G 21/3261 182/45
5,417,303 A * 5/1995 Bell ..... A62B 35/0068 182/129
5,595,260 A * 1/1997 Jalla ..... A62B 35/0068 182/3
5,711,399 A * 1/1998 Wayne-Prejean ..... E06C 1/10 182/187
5,816,636 A * 10/1998 Gibson ..... B66C 21/04 294/75
5,964,316 A * 10/1999 Roy ..... A62B 35/0068 182/3
6,050,077 A * 4/2000 Muller ..... A63B 29/028 57/210
6,056,086 A * 5/2000 Gortan ..... A62B 35/04 182/197
D604,912 S * 11/2009 Paul ..... D29/124
7,814,938 B2 * 10/2010 Davis, Jr. ..... A62B 1/16 138/106
8,225,905 B2 * 7/2012 Delaittre ..... A62B 1/14 182/190
8,292,245 B2 * 10/2012 Schindler ..... F16L 3/012 137/355.16
8,398,134 B1 * 3/2013 Mortensen ..... B66F 19/00 248/925
8,464,832 B1 * 6/2013 Rullo ..... A62B 35/0037 182/192
8,887,866 B2 * 11/2014 Petty ..... A63B 27/00 182/133
2004/0035993 A1 * 2/2004 Curtin ..... E04G 21/3261 248/237
2004/0154869 A1 * 8/2004 May ..... B66B 9/187 187/239
2009/0188753 A1 * 7/2009 Liang ..... A63B 27/00 182/133
2010/0078261 A1 * 4/2010 Watts ..... A62B 35/00 182/9
2010/0089694 A1 * 4/2010 Paul ..... A63B 27/00 182/9
2010/0213004 A1 * 8/2010 Petty ..... A62B 35/005 182/5
2011/0036287 A1 * 2/2011 Wijning ..... B63B 35/4413 114/74 R
2011/0155420 A1 * 6/2011 Ollgaard ..... B66D 1/36 174/135
2011/0290586 A1 * 12/2011 Goldmann, II ..... A63B 27/00 182/3
2013/0240298 A1 * 9/2013 Naylor ..... A62B 35/00 182/231
2015/0136525 A1 * 5/2015 May ..... A62B 1/02 182/142

FOREIGN PATENT DOCUMENTS

DE 29922278 U1 * 3/2000 ..... A62B 35/005
EP 2698184 A2 2/2014
FR 2951743 A1 4/2011
GB 2251020 A * 6/1992 ..... E04D 13/12
GB 2334292 A 8/1999
JP 2002-13294 A 1/2002
JP 2008086709 4/2008
WO 99/27213 6/1999
WO WO 9927213 A1 * 6/1999 ..... A62B 35/0068
WO 0238887 A1 5/2002
WO WO 0238887 A1 * 5/2002 ..... A62B 35/0068
WO 03/039681 A1 5/2003

* cited by examiner

TEMPORARY FALL PROTECTION

TECHNICAL FIELD

The present invention generally concerns fall protection systems that are employed in association with performing work on tall structures and specifically relates to such systems used in association with towers, pylons and masts in general and transmission line or communication towers in particular.

BACKGROUND

Performing regular inspection, service and overhaul as well as unscheduled repair work on tall structures such as towers, pylons, masts or chimneys does often involve climbing the structure. Due to the considerable height of said structures such work requires very effective fall arrest or fall protection systems that ensure the safety of workers climbing the structures. Such systems normally include safety lines that are attached stationary or removably to the structures. In both cases they are normally secured to a top portion of the structure and are guided along the full height thereof by straps or the like that are attached to a leg of a tower etc. Workers connect their personal protection equipment (PPE) to the safety line of the system in connection with each climbing. In WO03/039681 A1 is disclosed an example of such a fall arrest system that is specifically intended for transmission line towers or pylons that support high-voltage transmission lines. Due to the great risks involved and to the stationary placement of the fall protection systems, causing them to be exposed to various weather conditions, regular inspection (e.g. once each year) of the stationary attached systems is a requirement. In addition to a considerable investment cost for the systems having a stationary safety line attached to each structure, such as the towers of power transmission lines, the mentioned inspection is very time consuming and thereby adds to the expense.

Safety lines being removably attached to a structure must be reinstalled by a worker climbing the structure every time that they are to be taken into service. In other words the safety lines of such systems must be secured to the top of the structure and re-guided through the straps. Not only does this require much expensive reinstallation time but it also requires special safety measures each time a safety line shall be fitted by a worker climbing the structure.

RELATED ART

In GB 2 334 292 A is disclosed a temporary assembly for improving safety during work in association with building roofs. The assembly includes an inertia reel that is fixed to a saddle-type device that is in turn loosely positioned over the apex of a pitched roof and anchored to the roof by anchoring lines attached to the saddle device. For a preferred installation a projectile being attached to an anchoring line is thrown over the roof with the anchoring line. The anchoring line is then used to pull the saddle device up onto the roof.

SUMMARY

It is an object of the present invention to provide a solution to the above discussed problems.

In particular it is an object of the invention to suggest an improved method of installing fall protection in association with towers, pylons and masts in general and power transmission line or communication towers in particular.

In particular it is another object of the invention to suggest an improved assembly for installing fall protection in association with towers, pylons and masts in general and power transmission line or communication towers in particular.

These and other objects are met by the invention as defined by the accompanying claims.

The invention generally relates to a method of handling fall protection systems in association with towers, pylons and masts in general and power transmission line or communication towers in particular and involving climbing such a tower. In a basic configuration of the method a guide channel is secured to a top portion of the tower and a fall protection guide line is extended through the guide channel. A first end of a fall protection system is connected to a first end of the guide line, the fall protection system is extended through the secured guide channel by pulling a second end of the guide line, the first end of the fall protection system is secured to a ground level fixing point and a second end of the fall protection system is connected to personal protection equipment worn by a worker.

In another aspect the invention relates to an assembly for handling fall protection systems in association with towers, pylons and masts in general and power transmission line or communication towers in particular. In a basic configuration the assembly has a guide channel for fixing to a top portion of such a tower and a fall protection guide line for extension through the guide channel and having a first end for connection to a fall protection system on one side of the guide channel and a second end for pulling the fall protection system through the guide channel on the other side of the guide channel.

The basic assembly for fall protection installment presents the advantages of:

- permitting repeated temporary installment and removal of fall protection systems;
- secure, easy, quick and convenient repeated installment once the assembly is in position;
- allowing protection system to be removed and checked at optional site after each use; and
- allowing the use and replacement of optional types of fall protection systems.

Preferred further developments of the basic inventive idea as well as embodiments thereof are specified in the dependent subclaims.

Advantages offered by the invention, in addition to those described above, will be readily appreciated upon reading the below detailed description of embodiments of the invention.

BRIEF DESCRIPTION OF THE DRAWINGS

The invention and its further objects and advantages will be best understood by reference to the following description taken together with the accompanying drawings, in which.

DETAILED DESCRIPTION

Figure 1A:
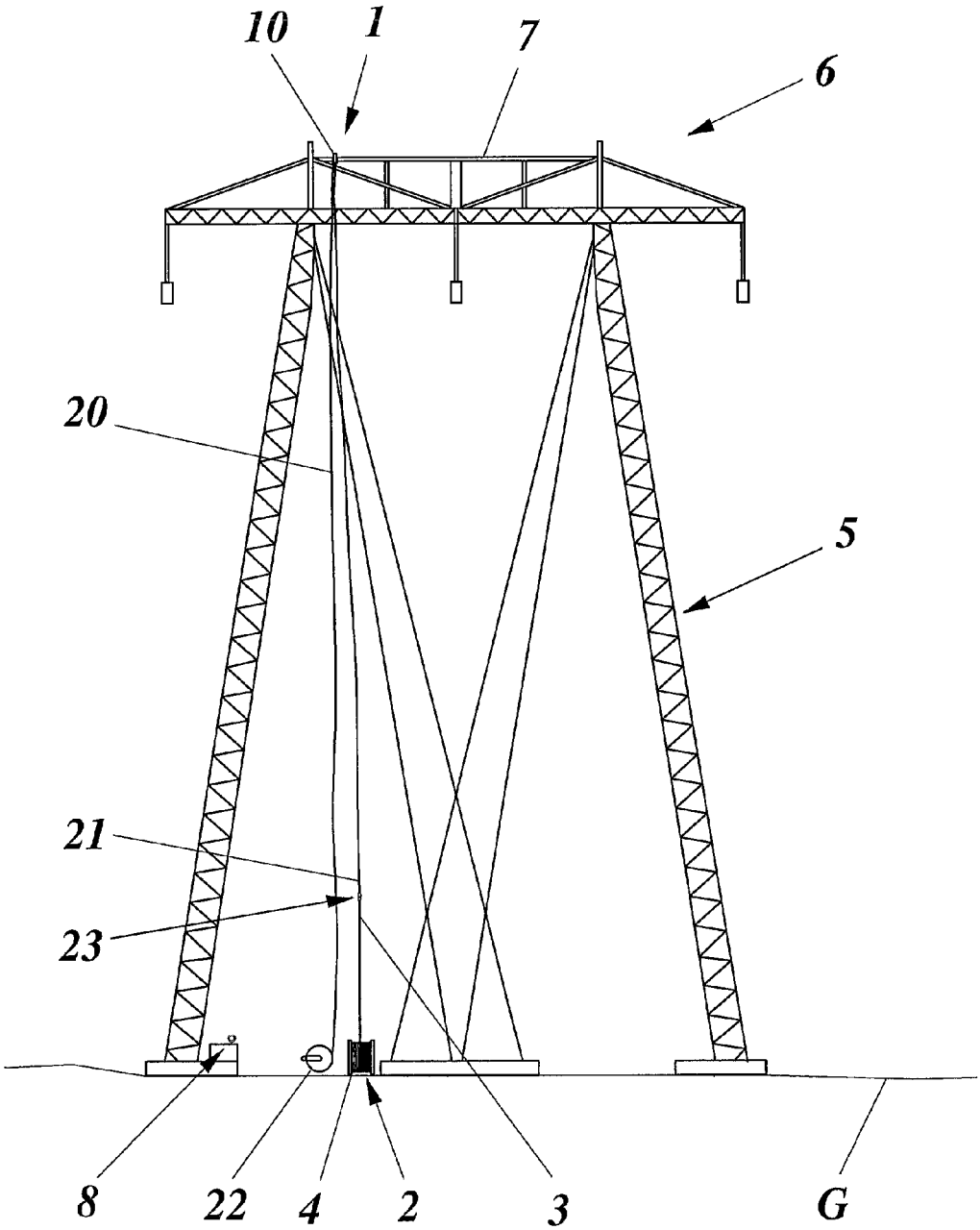
FIG. 1A is a schematical illustration of a power transmission line tower with a fall protection system handling assembly according to the invention installed thereon.

The invention will be explained with reference to exemplifying embodiments of a fall protection handling assembly of the invention and of a method of handling fall protection systems in association with tall structures. These embodiments of the invention are illustrated in the accompanying drawing figures and relate to an application of the inventive solution to towers of a high voltage power transmission line. It is emphasized that the illustrations are for the sole purpose of describing exemplary embodiments of the invention and are not intended to limit the invention to details or to any specific field of application thereof. The inventive solution may thus be used with and for other tall structures, including in association with towers, pylons and masts, and even chimneys in general and power transmission line or communication towers in particular, and for specific fall protection systems that are appropriate for such applications. The expression transmission tower shall therefore throughout this specification include any type of power line or communication pylon/tower or any other mast, chimney or tower of considerable height where fall protection systems are employed on a regular basis. It shall be realized that the invention covers the incorporation of such application related features and any combination of features disclosed herein.

As was discussed in the introduction fall protection systems used so far on tall structures such as transmission towers are burdened by very high costs. A power transmission line may have hundreds of towers each requiring a separate fall protection system. The initial costs as well as costs for the regular inspection and maintenance will therefore be considerable. It is apparent that the safety issues are vital in this area and that the quality and thus the costs for the actual fall protection systems and for their maintenance cannot be unduly reduced.

The invention attempts to overcome disadvantages and problems encountered with known fall protection systems for tall structures and proposes a new approach for employing fall protection in such applications. A general object of the invention is to provide inexpensive and secure alternatives to stationary fall protection systems for tall structures. The solution of the invention shall provide secure, reliable fall protection at significantly reduced cost, both with regard to investment and to regular service and inspection. Specifically, the basic idea of the proposed solution is to provide an assembly for permitting temporary installment of a temporary fall protection system that may be easily, quickly and conveniently installed and uninstalled in association with each use thereof. This will provide the desired reduction in investment cost as well as in maintenance and service work. Another major advantage of the inventive assembly is the practical and convenient removal of the fall protection system, allowing the user to carefully examine the system for damages before and after each use.

Figure 1B:
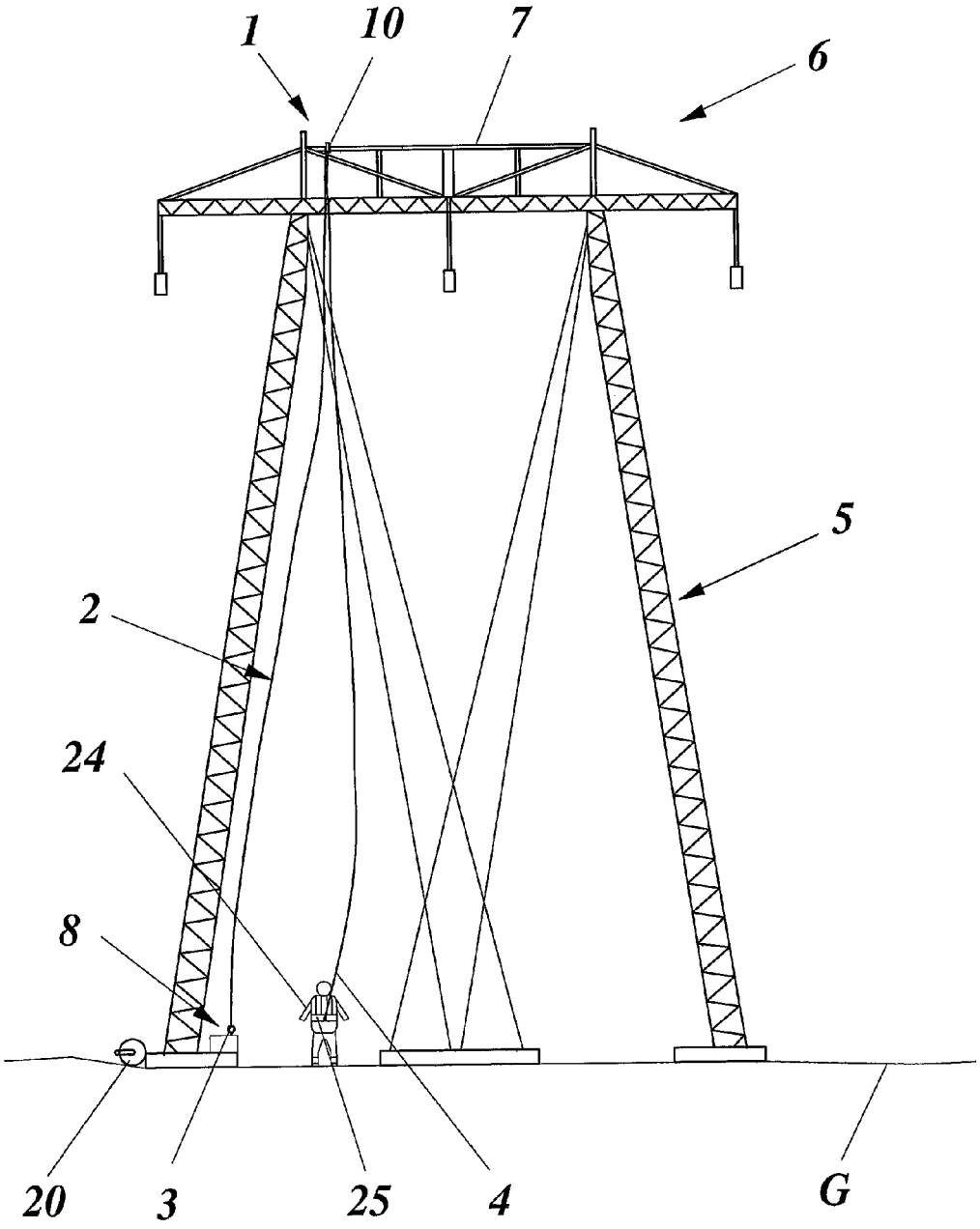
FIG. 1B is a schematical illustration of the power transmission line tower of FIG. 1A with the inventive fall protection system handling assembly installed thereon.
Figure 2B:
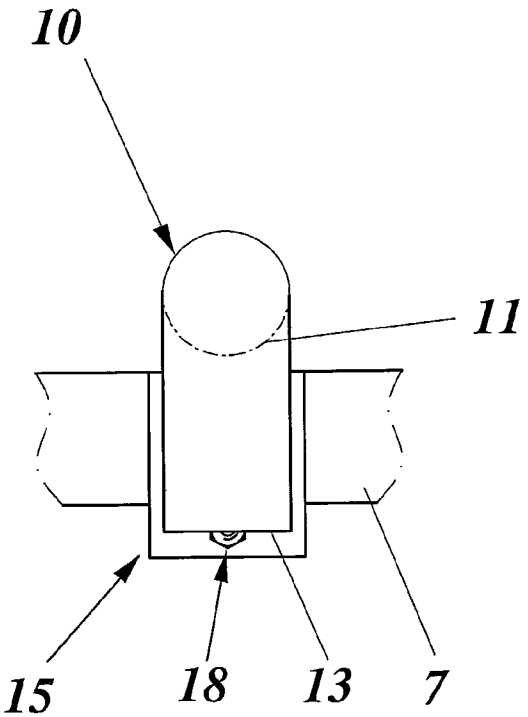
FIG. 2B is a side view of the detail of the upper beam of FIG. 2A, likewise showing the installed guide channel of the assembly of FIGS. 1A-B.
Figure 2A:
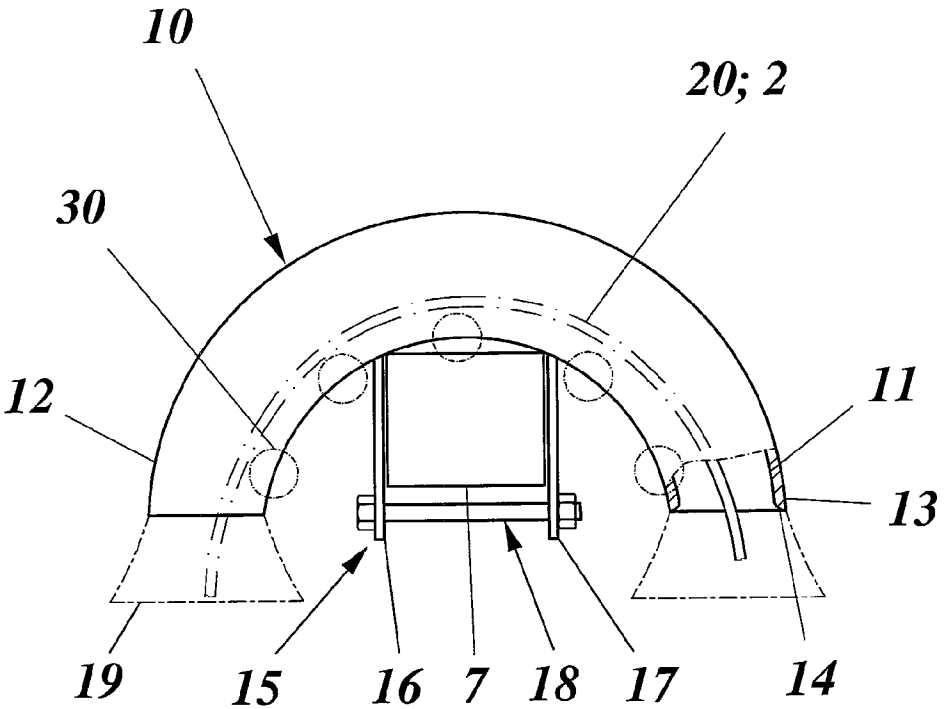
FIG. 2A is a schematical end view of a detail of an upper beam of a power transmission line tower having the guide channel of the assembly of FIGS. 1A-B installed thereon.

The invention will be explained below with reference to exemplifying schematical embodiments thereof that are illustrated in the accompanying drawing FIGS. 1A-B, 2A-B and 3. In FIGS. 1A-2B is disclosed an exemplary embodiment of the inventive assembly to which the basic concept of the invention has been applied. In particular, FIGS. 1A-1B schematically illustrate a power transmission line tower 5 to which is attached an assembly 1 for installing and removing a fall protection systems 2 in association with said transmission tower 5. The assembly includes a guide channel 10 for attachment to a transmission tower 5 and a fall protection guide line 20 for extension through the guide channel 10. The guide channel 10 is here attached to a transmission tower 5 top portion 6, such as an upper beam 7. The guide channel 10 has attachment means 15 for securing it to the upper beam 7 of the transmission tower 5. The attachment means 15 are here exemplified by two spaced plates 16, 17 that are fixed to the guide channel 10 and are used to clamp the guide channel to the upper beam 7 by means of a nut and bolt fastener 18. Other types of suitable attachment means may naturally likewise be employed.

The guide channel 10 has the general shape of a tubular bend for guiding initially the guide line 20 and subsequently the fall protection system 2 securely across the upper beam 7. The guide channel 10 is preferably formed having a smooth continuous inner surface 11 that at open ends 12, 13 of the guide channel 10 merge with smoothly curved outer edges 14 of the guide channel 10. This will avoid damaging the guide line 20 or the fall protection system 2 during extension thereof through the guide channel 10. As is indicated with dash-dot lines in FIG. 2A, generally funnel shaped end pieces 19 may be provided at each channel end 12, 13. This will even further secure proper guiding of guide line 20 and fall protection 2 ends, and possible, later mentioned interfitting connectors 23, into the channel 10. For the same reason an appropriate number of idling guide rolls 30 (likewise indicated with dash-dot lines in FIG. 2A) may be provided at the inner surface 11 of the channel wall. Such a supplementary guide may be provided for applications with high fall protection loads, such as by very tall structures where the weight of the fall protection system 2 will be considerable.

The guide channel 10 is advantageously formed having the general shape of an approximately 90° to 180° tubular bend, where the most suitable angle will depend upon the actual application. Such a configuration will allow the guide line 20 as well as the fall protection system 2 to be appropriately extended from ground G level up to and through the guide channel 10 and back down to ground G level on the opposite side of the guide channel 10. During the installation of the fall protection system 2 with the assembly 1 of the invention, said system may be extended through conventional brackets or straps (not shown) distributed along the structure, such as a leg of a power transmission line tower 5.

For the purposes of the invention the guide line 20 has a length approximately equal to or slightly exceeding two times the height of the top portion 6, or specifically of the upper beam 7, of the transmission line tower 5 above ground G. The guide line has a first end 21 intended for connection to a fall protection system 2, such as a safety line, by means of not specifically shown interfitting connectors 23. In use this first end 21 of the guide line 20 is positioned on one side of the guide channel 10, close to ground G level. The guide line 20 further has a second end 22 that in use will be positioned on the other side of the guide channel 10, having been extended therethrough. This second end 22 will be used for pulling the fall protection system 2 through the guide channel 10 to the other side thereof and down to ground G level.

The guide line 20 does not need to have any exceptional mechanical or physical properties since it is solely used to pull the fall protection system 20 up to and through the guide channel 10 and therefore does not need to carry any great load and will not be subjected to any considerable wear. Thus, the strength of the guide line may be selected to be very low in comparison to the strength of the safety line or other member of the fall protection system 2. However, it is preferred to use a non-ageing guide line 20 that is formed of or covered by age-proof material and that will be suitable for permanent positioning on a tower, pylon or mast, such as a power transmission line tower 5.

The assembly 1 of the invention further includes a ground G level fixing point 8 of quite conventional type and for securing one end 3 of the temporary fall protection system 2 to ground G subsequent to the extension thereof through the guide channel 10 and prior to connecting a second end 4 thereof to personal protection equipment 25 worn by a user 24.

Figure 3:
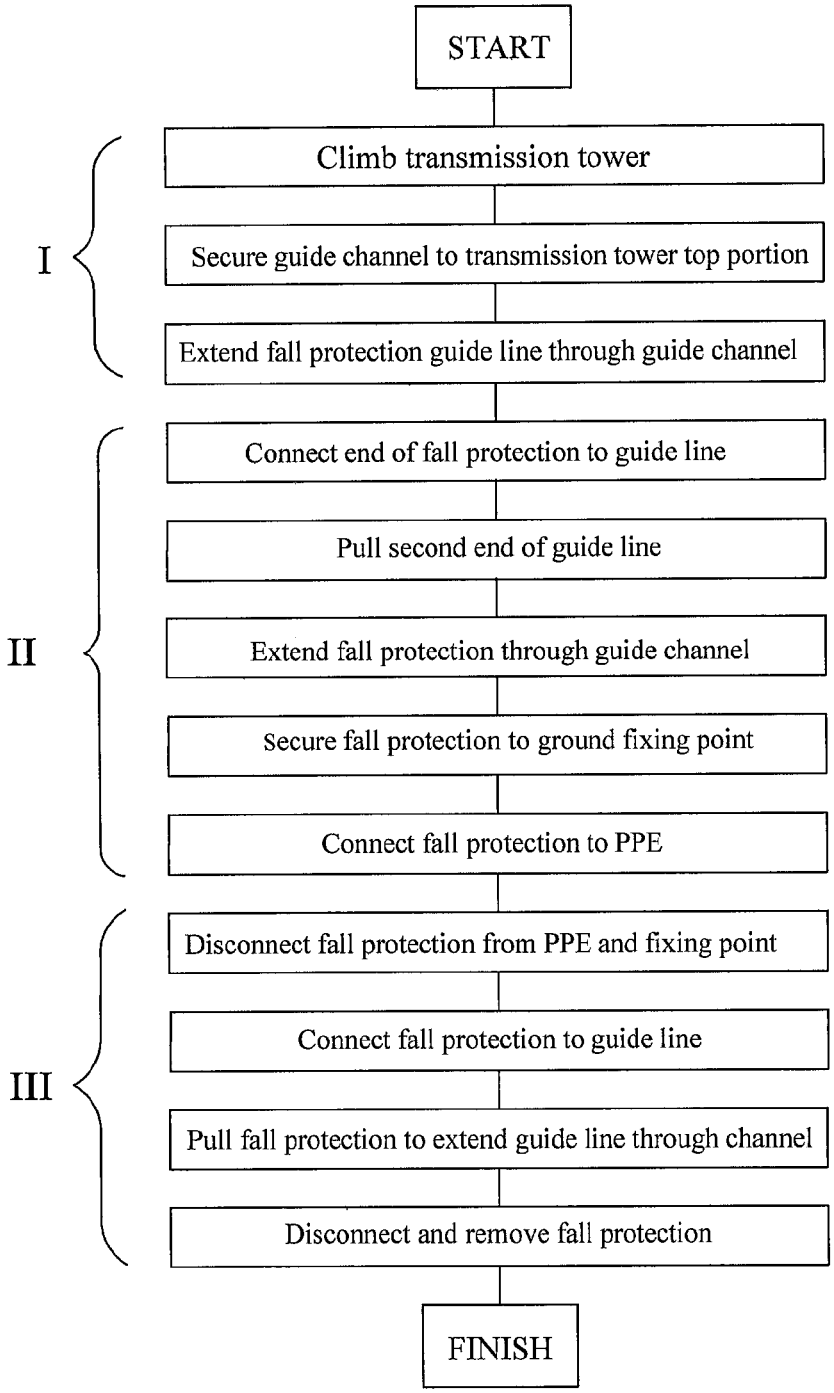
FIG. 3 is a schematical illustration of an exemplifying embodiment of an inventive method for handling fall protection systems for power transmission line towers.

Next, an embodiment of a method according to the invention will be briefly described with reference to FIG. 3. The method concerns handling fall protection systems 2 in association with transmission towers 5, such as the illustrated power transmission line tower 5. Initially, prior to actual use of the fall protection system 2, the method involves climbing the transmission tower 5 up to the top portion 6 thereof. A guide channel 10 and one end 21 or 22 of a guide line 20 are simultaneously brought up to said tower 5 top portion 6. The guide channel 10 is then secured to the upper beam 7 at the transmission tower 5 top portion 6 and the fall protection guide line 20 is extended through the guide channel 10 until both ends 21, 22 thereof are located at ground G level, on opposite sides of the guide channel 10. This is a one-time installation phase I of the method.

With the assembly 1 guide channel 10 and guide line 20 in position a first end 21 of the guide line 20 is at ground G level connected to a first end 3 of a temporary fall protection system 2 using the interfitting connectors 23. The fall protection system 2 is then extended through the secured guide channel 10 by pulling a second end 22 of the guide line 20 until the fall protection 2 first end 3 reaches ground G level. Said first end 3 of the fall protection system 2 is secured to a ground G level fixing point 8 and a second end 4 thereof is secured to personal protection equipment (PPE) 25 worn by a worker 24 that is about to climb the transmission tower 5 to perform maintenance and/or repair work. This is a fall protection activation phase II of the method that will be repeated for each service or maintenance occasion.

For removing the temporary fall protection system 2 after completed work on the transmission tower 5, the first and second ends 3, 4 thereof are disconnected from the ground G level fixing point 8 and from the personal protection equipment (PPE) 25 worn by the worker 24, respectively. The first or second end 3, 4 thereof is reconnected to the guide line 20 and the fall protection system 2 is then pulled back through the guide channel 10 with the guide line 20 attached thereto. When the guide line 20 has been extended through the guide channel 10 again the fall protection system 2 is disconnected from it and may be removed from the site of the power transmission line tower 5 to be used on other transmission towers etc. This completes the fall protection removal phase III of the method. The guide line 20 will on the other hand normally be left in position on the transmission tower 5, extended through the guide channel 10, until a next installment of a fall protection system 2 thereto.

It will be realized that the object of the invention has been achieved by developing a type of top guide in combination with a stationary line used to pull a mobile and temporary fall protection system across the top of the tall structure and back down to an anchoring point at ground level. The guide is a "pipe channel" that is permanently secured to a top area of the tower and through which the line is extended. The pull line is not part of the actual fall protection and therefore requires no regular inspection. Its main purpose is to pull and guide a fall protection system safety line over the top of the tower and back down to ground. A non-ageing line is preferably employed in order to avoid frequent replacement. Since a personal fall protection system is always pulled up and used with the invention, a user may always check and inspect his equipment on the ground. This means that safety may always be guaranteed.

In alternative, but not specifically illustrated embodiments of the invention variations of the different illustrated parts of the inventive assembly may be employed without departing from the scope of the invention. An example of this is the use of alternative attachment means for the guide channel. Likewise, depending upon the actual tall structure, the guide channel may be secured to other appropriate locations at the top portion of a structure, and not necessarily to the illustrated upper beam. As alternatives to the above mentioned idling guide rollers 30, the guide channel may be formed of low friction material or its inner surface may be coated with such material. It shall also be emphasized that although the invention has been described and illustrated with specific reference to an application in a power transmission line, the invention is in no way restricted to such applications. The basic principles of the invention may be applied to other tall structure applications.

The invention has been described in connection with what is presently considered the most practical and preferred embodiments but it shall be understood that the invention is not limited to the disclosed embodiments. It likewise covers any feasible combination of features described and illustrated herein and is therefore intended to cover various modifications and equivalent arrangements included within the spirit and scope of the appended claims.

The invention claimed is:

1. A method of handling safety lines in association with structures, the method comprising:

climbing a structure;

securing a guide channel to an upper beam of a top portion of the structure;

extending a guide line through the guide channel and across the upper beam of the structure;

connecting a first end of a safety line to a first end of the guide line;

extending the safety line through the guide channel and across the upper beam of the structure by pulling a second end of the guide line;

while the safety line is extended through the guide channel, disconnecting the first end of the safety line from the first end of the guide line, and securing the first end of the safety line to a ground level fixing point; and securing a second end of the safety line to personal protection equipment worn by a worker.

2. The method according to claim 1, comprising:

disconnecting the first end of the safety line from the ground level fixing point;

disconnecting the second end of the safety line from the personal protection equipment;

connecting the first end or the second end of the safety line to the guide line;

extending the guide line through the guide channel by pulling the safety line back through the guide channel; and disconnecting the safety line from the guide line.

3. The method according to claim 2, comprising:

leaving the guide line extended through the guide channel until a subsequent installment of a temporary safety line.

4. The method according to claim 1, comprising:

selecting a guide line having a strength that is less than the strength of the safety line.

5. The method according to claim 1, comprising:

using a non-ageing guide line suitable for permanent positioning on the structure.

* * * * *